United States Patent [19]

Fukayama

[11] Patent Number: 4,703,722

[45] Date of Patent: Nov. 3, 1987

[54] BOILER STARTING SYSTEM

[75] Inventor: Yukio Fukayama, Hiroshima, Japan

[73] Assignee: Babcock-Hitachi Kabushiki Kaisha, Tokyo, Japan

[21] Appl. No.: 851,728

[22] Filed: Apr. 14, 1986

[30] Foreign Application Priority Data

Apr. 13, 1985 [JP] Japan ..... 60-77538

[51] Int. Cl.[4] ..... F22D 7/00

[52] U.S. Cl. ..... 122/406 ST; 60/646; 60/666

[58] Field of Search ..... 60/646, 648, 666; 122/406 ST, 441, 442

[56] References Cited

U.S. PATENT DOCUMENTS 2,900,792 8/1959 Buri .
4,316,362 2/1982 Ninomiya et al. ..... 60/646
4,448,026 5/1984 Binstock et al. ..... 60/666 X

FOREIGN PATENT DOCUMENTS 1152151 2/1958 France .
1272052 7/1960 France .
1344074 1/1963 France .

OTHER PUBLICATIONS

EP 86 10 5015-European Search Report.

*Primary Examiner*—Edward G. Favors
*Attorney, Agent, or Firm*—Antonelli, Terry & Wands

[57] ABSTRACT

A boiler starting system for starting a boiler which has a superheater and at least two reheaters. The boiler starting system has a steam extracting line for extracting the steam from the steam inlet side or an intermediate portion of the superheater, and a steam supply valve by which the extracted steam is supplied to the reheaters. The flow rates of steam through the superheater and each reheater are controlled independently to realize optimum steam temperature rising characteristics, without requiring increase in the capacities of valves and other elements of the starting system.

7 Claims, 19 Drawing Figures

FIG. 2A
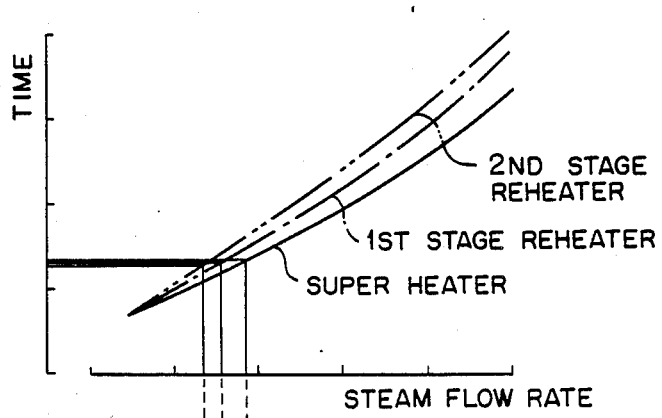
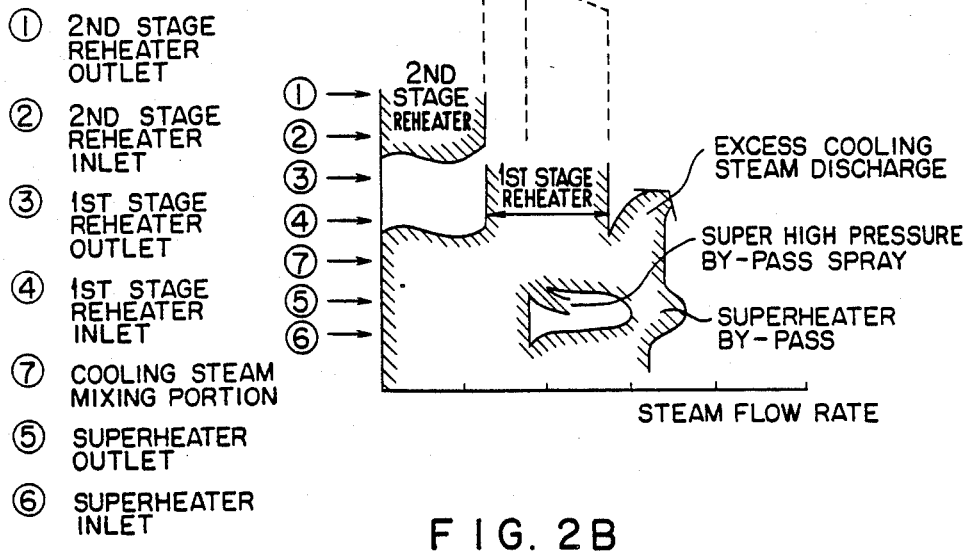
FIG. 2B

FIG. 6A
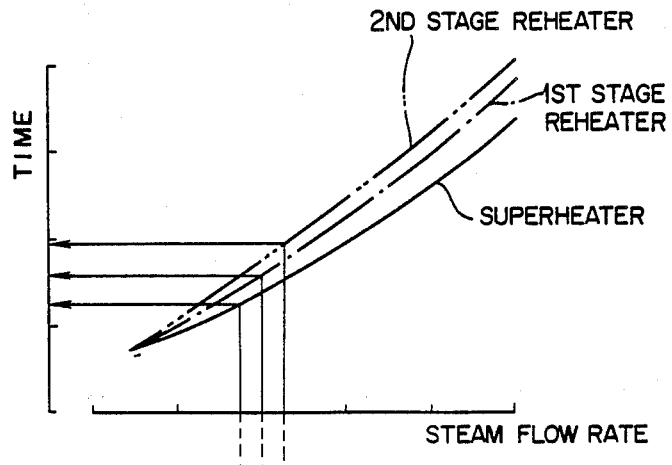
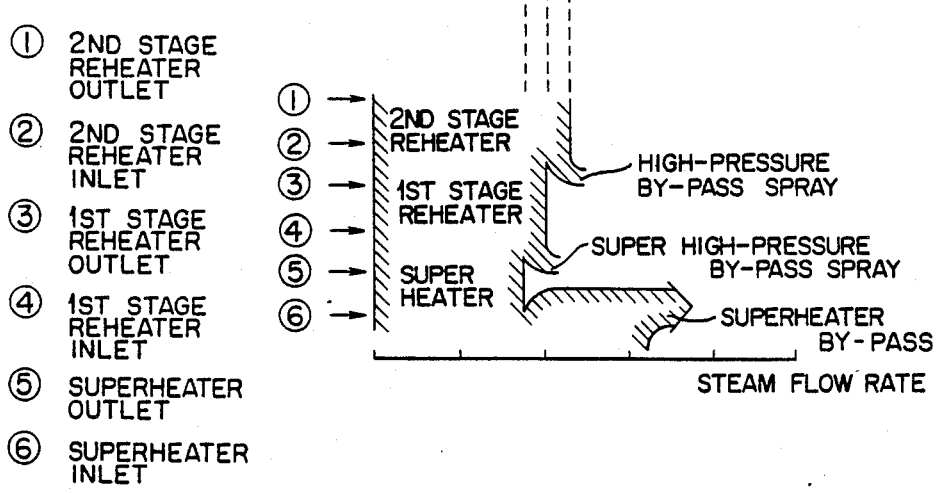
FIG. 6B

FIG. 8A
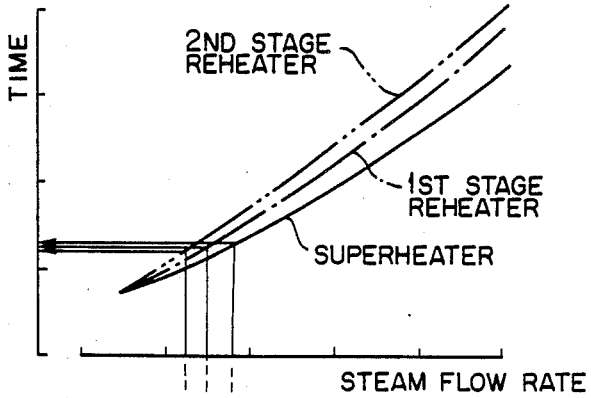
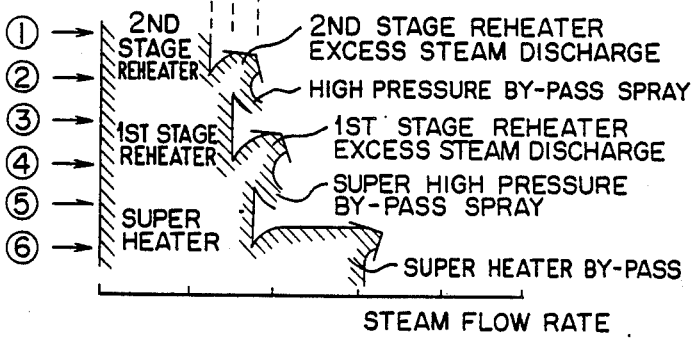
FIG. 8B

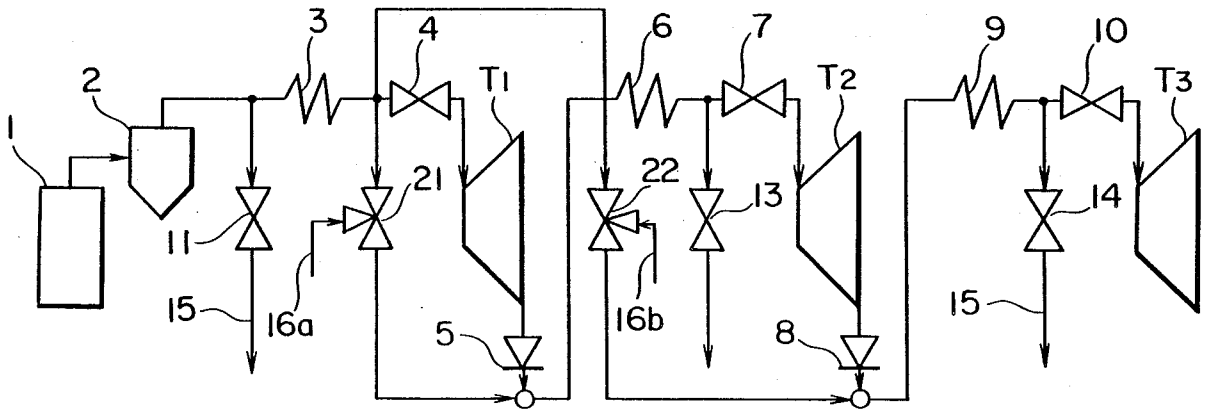
FIG. 9 .PRIOR ART

FIG. 10A
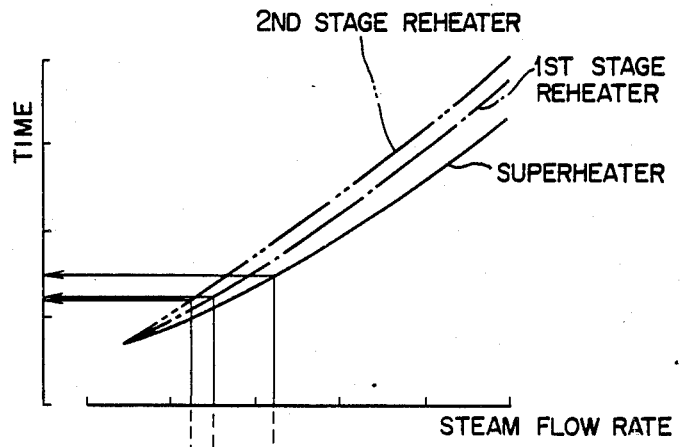
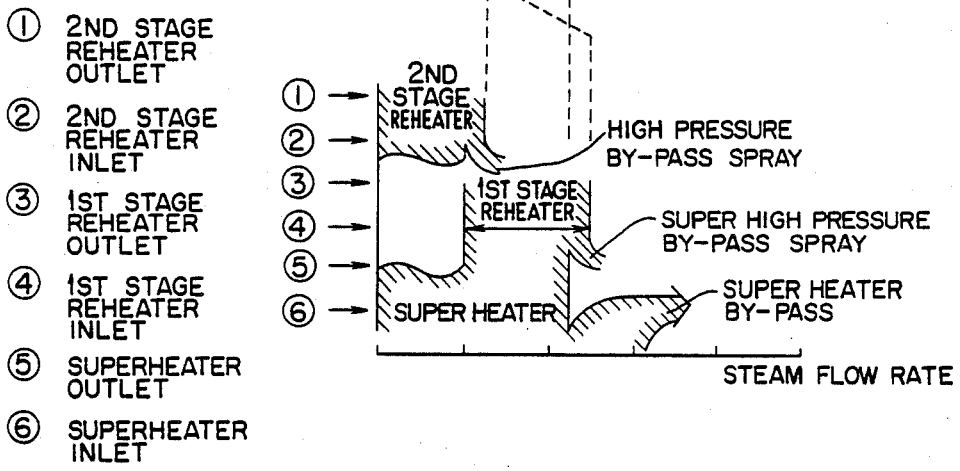
FIG. 10B

BOILER STARTING SYSTEM

FIELD OF THE INVENTION AND RELATED ART STATEMENT

The present invention broadly relates to a boiler starting system and, more particularly, to a boiler starting system for starting a boiler having a reheater.

As well known to those skilled in the art, in starting of a boiler for supplying steam to a steam turbine, the supply of the steam to the turbine is not conducted until the temperature and the pressure of the steam in the boiler reach predetermined levels. In the case where the boiler has two or more stages of reheater, it is necessary that cooling steam is supplied to the reheater before the supply of the steam to the turbine is commenced. This system will be explained hereinunder with reference to the drawings.

FIG. 5 shows a system for starting a boiler having a reheater system arranged in two stages. The boiler produces steam for driving a turbine system composed of a super-high-pressure turbine $T_1$, a high-pressure turbine $T_2$ and a medium-pressure turbine $T_3$. The boiler has generating tubes 1 disposed in a furance. The steam generated in the generating tubes 1, still containing water, is sent to a steam separator 2 where the water content is removed. The separated steam is superheated in a superheater 3 and then supplied to the super-high-pressure turbine $T_1$, through a super-high-pressure stop valve 4. A reference numeral 5 denotes a check valve. The steam expanded through the super-high-pressure turbine $T_1$ is reheated in a first-stage reheater 6 and the reheated steam is fed to the high-pressure turbine $T_2$ through a high-pressure turbine stop valve 7. A reference numeral 8 denotes a check valve. The steam coming out the high-pressure turbine $T_2$ is reheated in a second-stage reheater 9 and then supplied to the medium-pressure turbine $T_3$ through a medium-pressure turbine stop valve 10.

A reference numeral 11 denotes a superheater by-pass valve for by-passing the steam which is supplied to the superheater 3. When the superheater by-pass valve is opened, a part of the steam by-passes the superheater 3 so as to prevent any excessive temperature drop at the outlet of the superheater 3. A numeral 12 denotes a super-high-pressure turbine by-pass valve which permits the superheated steam from the superheater 3 to by-pass the super-high-pressure turbine $T_1$ when the plant is started up. The opening of the super-high-pressure by-pass valve 12, i.e., the flow rate of the by-passing superheated steam through the valve 12, is so controlled that a predetermined steam pressure is maintained at the outlet of the superheater 3. A high-pressure turbine by-pass valve 13 is adapted to allow the steam from the first-stage reheater 6 to by-pass the high-pressure turbine $T_2$. The flow rate of the by-passing reheated steam through the valve 13 is so controlled that a predetermined pressure is maintained at the outlet of the first-stage reheater 6. A reference numeral 14 designates a medium-pressure turbine by-pass valve which permits the steam from the second-stage reheater 9 to by-pass the medium-pressure turbine $T_3$. The flow rate of the by-passing reheated steam through the valve 14 is so controlled that a predetermined steam pressure is maintained at the outlet of the second-stage reheater 9. A numeral 15 denotes a condenser damp line, **16*a* denotes a water spray line through which water is sprayed into the super-high-pressure turbine by-pass valve 12, and 16*b* denotes a water spray line through which water is sprayed into the high-pressure turbine by-pass valve 13**.

The operation of the described starting system is as follows. During normal operation, the steam temperatures and pressures suitable for the steam supply to the steam turbines $T_1$, $T_2$ and $T_3$ are maintained at the outlets of the superheater 3, the first-stage reheater 6 and the second-stage reheater 9. In this state, the super-high-pressure turbine stop valve 4, high-pressure turbine stop valve 7 and the medium-pressure turbine stop value 10 are all opened, while the superheater by-pass valve 11, the super-high-pressure turbine by-pass valve 13 and the medium-pressure turbine by-pass valve 14 are all closed. Thus, the steam generated in the boiler flows through the superheater 3, the super-high-pressure turbine $T_1$, the first-stage reheater 6, the high-pressure turbine $T_2$, the second-stage reheater 9 and the medium-pressure turbine $T_3$, whereby the steam turbine $T_1$, $T_2$ and $T_3$ are driven.

In contrast, when the boiler starts, the steam temperature and pressure at the outlet of the superheater 3 are still lower than those suitable for the supply to the super-high-pressure turbine $T_1$. In this case, therefore, the super-high-pressure turbine stop valve 4 is fully closed, while the super-high-pressure turbine by-pass valve 12 is opened to allow the steam from the superheater 3 to by-pass the super-high-pressure turbine $T_1$. The steam by-passing the turbine $T_1$ is then introduced into the first-stage reheater 6 to prevent any burning of the first-stage reheater 6. At the same time, water is sprayed through the water spray line **16*a* into the first-stage reheater 6 such that the steam temperature in the reheater 6 is maintained within a range which is low enough to effectively cool the reheater 6 but is high enough to prevent the steam from becoming wet. Meanwhile, the flow rate of the steam flowing through the super-high-pressure turbine by-pass valve 12 is so controlled that a predetermined steam pressure is maintained at the outlet of the superheater 3**, as explained before.

Similarly, during the starting of the boiler, the high-pressure and medium-pressure turbine stop valves 7, 10 are fully closed, while the high-pressure and medium-pressure turbine by-pass valves 13, 14 are opened. Therefore, the steam from the first-stage reheater 6 is introduced into the second-stage reheater 9 so as to prevent burning thereof. The steam is then discharged into the condenser damp line 15. In this case also, the steam from the first-stage reheater 6 is cooled by water sprayed through the water spray line **16*b*, and the flow rates of the steam through the high-pressure turbine by-pass valve 13 and the medium-pressure turbine by-pass valve 14 are controlled in a manner explained before. In normal starting up of the boiler, the flow rate of the steam in the superheater by-pass valve 11 is substantially the same as the flow rate of the steam in the superheater 3**.

FIG. 6A is a characteristic chart showing the time required for the steam to reach the temperature suitable for the supply to the turbine for given steam flow rates in the superheater, the first-stage reheater and the second-stage reheater shown in FIG. 5, while FIG. 6B is a chart showing the ratios of flow rates of steam in the superheater and reheaters. The abscissas in FIGS. 6A and 6B denote the steam flow rate by the same scale. Referrring to FIG. 6B, about a half of the steam generated in the boiler shunts to the superheater by-pass valve 11 at the inlet of the superheater 3. To the inlet of the first-stage reheater 6 the steam including not only the steam from the superheater 3 but the water sprayed from the water spray line 16*a* is supplied. Similarly, the steam including not only the steam from the first-stage reheater 6 but the water sprayed from the water spray line 16*b* is supplied to the inlet of the second-stage reheater 9. Where the steam flow-rates are as shown in FIG. 6A, the time required for the temperature rise is the shortest for the main steam and longest for the second-stage reheated steam, with the first-stage reheated steam falling intermediate.

From FIGS. 6A and 6B, it will be seen that the system shown in FIG. 5 encounters the following problems.

(1) The steam flow rate is increased along the main steam line as a result of water spray from the water spray lines 16*a*, 16*b* of the super-high-pressure turbine by-pass valve 12 and the high-pressure turbine by-pass valve 13. In consequence, the capacity or volume of the medium-pressure turbine by-pass valve 14, which is on the outlet side of the second-stage reheater 9, has to be extremely large, because of the increase of the specific volume of the steam therein, which is caused by decreasing of the steam pressure. This is quite inconvenient from the economical point of view.

(2) The steam temperature at the outlets of the first- and second-stage reheaters 6 and 9 rise slowly due to increase in the steam flow rates. Accordingly, the time spent on starting of the boiler is prolonged.

(3) In general, the temperature of the steam to be supplied to a steam turbine should not be too high nor too low with respect to the turbine metal temperature. This means that the turbine has to be driven by the steam after the steam temperature has been raised to the adequate temperature, otherwise the steam will become too hot. This in turn requires a delicate control for raising the steam temperature at the outlets of the superheater and reheaters, in order to enable a simultaneous start of steaming to the turbines $T_1$, $T_2$ and $T_3$. In the described starting system, however, such a delicate control for raising the steam temperature is extremely difficult to conduct because the independent control of the steam flow rates for the super heater and reheaters cannot be carried out due to that the steam flows successively through the superheater 3, the first-stage reheater 6 and the second-stage reheater 9.

(4) The spray of water into the superheated steam from the superheater 3 for the purpose of cooling of the reheaters 6 and 9 requires attentions in order to avoid any wetting of the steam and lowering of the steam temperature after the water spray. In addition, the spray of the cooling water into the superheated steam tends to produce excessive reheated steam of impractically low pressure.

FIG. 7 shows another system for starting a boiler which also has a two-stage reheating system. In this Figure, the same reference numerals are used to denote the same elements as those appearing in FIG. 5, and then the detailed description of such elements is omitted. In this system, an excess steam discharge valve 19 is provided in a line shunting from the line between the super-high-pressure turbine by-pass valve 12 and the first-stage reheater 6. The excess steam dischare valve 19 is intended for relieving the steam which is excess for the first-stage preheater 6. Similarly, an excess discharge valve 20 for relieving the excess steam for the second-stage reheater 9 is provided in a line which shunts from the line between the high-pressure turbine by-pass valve 13 and the second-stage reheater 9.

FIGS. 8A and 8B are diagrams showing the temperature-rise characteristics and the steam flow rate ratios, drawn in the same manner as FIGS. 6A and 6B explained before. Although the steam flow rate is increased at the outlet of the superheater 3 as a result of spray of water from the water spray line 16*a*, the flow rate of steam to be delivered to the first-stage reheater 6 is decreased because the excess steam is discharged through the steam discharge valve 19 at the inlet side of the first-stage reheater 6. An increase of the steam flow rate is observed also at the outlet of the first-stage reheater 6 as a result of water spray from the water spray line 16*b*, but the steam flow rate to be delivered to the second-stage reheater 9 is decreased as a result of discharge of the excess steam through the steam discharge valve 20.

It will be seen that the provision of the steam discharge valves 19 and 20 for discharging excess steam for the first- and second-stage reheaters 6 and 9 permits, through a suitable control of the rates of discharge of the steam from these valves 19, 20, adequate controls of the steam flow rates in the superheater and reheaters, as well as of the steam temperature rising time at the outlet of each of the first- and second-stage reheaters 6 and 9, thus eliminating the problems (1) to (3) mentioned before.

It is necessary that the temperature of the steam flowing into each reheater 6, 9 is maintained sufficiently low, in order to meet the restriction from the design temperature of the reheater. Accordingly, the spray of water into the super-high-pressure turbine by-pass valve 12 and the high-pressure turbing by-pass value 13 is essential. The spray of the water into these by-pass valves, however, produces excess steam. This is true also with the system shown in FIG. 5. In most cases, the steam flow rate passing through the superheater 3 is much greater than the steam flow rate which is required for controlling the temperature rise of the first-stage reheater 9. In order to decrease the temperature of this large quantity of steam passing through the superheater 3, it is necessary to spray the cooling water at a large rate. In consequence, a large quantity of steam is generated and, hence, the quantity of the excess steam is increased impractically.

In consequence, the system shown in FIG. 7 is irrational and uneconomical in that it experiences a drastic increase of the steam flow rate as a result of water spray at a large rate and immediately thereafter the discharge of a considerably large part of the steam as the excess steam. In addition, in the system shown in FIG. 7, the capacities of the super-high-pressure turbine by-pass valve 12, the water spray system therefor and the steam discharge valve 19 for discharging the excess steam for the first-stage reheater have to become large.

FIG. 9 shows still another system for starting a boiler having a two-staged reheater system. The same reference numerals are used to denote the same elements as those appearing in FIG. 5, and the detailed description of such elements is also omitted in this case. The starting system shown in FIG. 9 employs two lines shunting from the main steam line between the superheater 3 and the super-high-pressure turbine stop valve 4. One of the lines has first by-pass valve 21 by-passing the super-high-pressure turbine $T_1$, while the other line has a second by-pass valve 22 by-passing the super-high-pressure turbine $T_1$. The steam from the superheater 3 is divided into two parts, one part of which is supplied to the first-stage reheater 6 through the first by-pass valve 21 and the other part of which is supplied to the second-stage reheater 9 through the second by-pass valve 22.

FIGS. 10A and 10B are diagrams showing the steam temperature-rise characteristics and steam flow rate ratios in the same way as FIGS. 6A, 6B and 8A, 8B. It will be seen that the steam line from the superheater 3 is divided into two sub-lines, in one of which the water is sprayed in the first by-pass valve 21 from the water spray line 16*a*, so that the steam flow rate at the outlet of the first-stage reheater 6 is increased, and in the other line the water is also sprayed in the second by-pass valve 22 from the water spray line 16*b*, so that the steam flow rate is also increased at the outlet of the second-stage reheater 9. However, the steam flow rates at the outlets of the reheaters 6, 9 are smaller than those in the starting systems shown in FIGS. 5 and 7, because fractions of the steam from the superheater 3 are supplied to these reheaters, as will be seen from FIG. 10B. That is, the steam flow rate at the outlet of the superheater 3 is greater than those at the outlets of the first- and second-stage reheaters 6 and 9, so that a longer period is required for the steam to be heated at the outlet of the superheater 3, as will be seen from FIG. 10A. In this system, the steam from the superheater 3 is divided into two fractions, one of which is supplied to the first-stage reheater 6 and the other is supplied to the second-stage reheater 9. This arrangement is effective in eliminating the generation of the excess steam during starting of the boiler. This system, however, involves a problem that a considerably large steam flow rate has to be maintained in the superheater 3, in order to ensure the supply of steam to the first- and second-stage reheaters at rates which are large enough to prevent burning of these reheaters. In consequence, it is impossible to make full use of the function of the super-heater by-pass valve 11 for controlling the steam temperature rise at the outlet of the superheater 3, resulting in a delay of the temperature rise of the steam at the outlet of the superheater 3.

OBJECT AND SUMMARY OF THE INVENTION

Accordingly, an object of the invention is to provide a boiler starting system which affords an easy control of the steam temperature rise in the superheater and reheaters, while reducing the capacity of the elements of the starting system, thereby obviating the above-described problems of the prior art.

To this end, according to the invention, there is provided a boiler starting system in which steam is extracted from the inlet or an intermediate portion of the superheater and the extracted steam is to be supplied to at least one reheater.

BRIEF DESCRIPTION OF THE DRAWINGS

FIGS. 2A and 2B are diagrams showing the steam-temperature rising characteristics and the flow rate ratios in the boiler starting system shown in FIG. 1;

FIGS. 6A and 6B are diagrams showing the steam-temperature rising characteristics and the flow rate ratios in the known system shown in FIG. 5;

FIGS. 8A and 8B are diagrams showing the steam-temperature rising characteristics and the flow rate ratios in the boiler starting system shown in FIG. 7;

FIG. 9 is a steam flow diagram of still another known boiler starting system for starting a boiler having a two-stage reheating system;

FIGS. 10A and 10B are diagrams showing steam-temperature rising characteristics and the flow rate ratios in the known boiler starting system shown in FIG. 9.

DESCRIPTION OF THE PREFERRED EMBODIMENTS

Preferred embodiments of the invention will be explained hereinunder with reference to the accompanying drawings.

Figure 1:
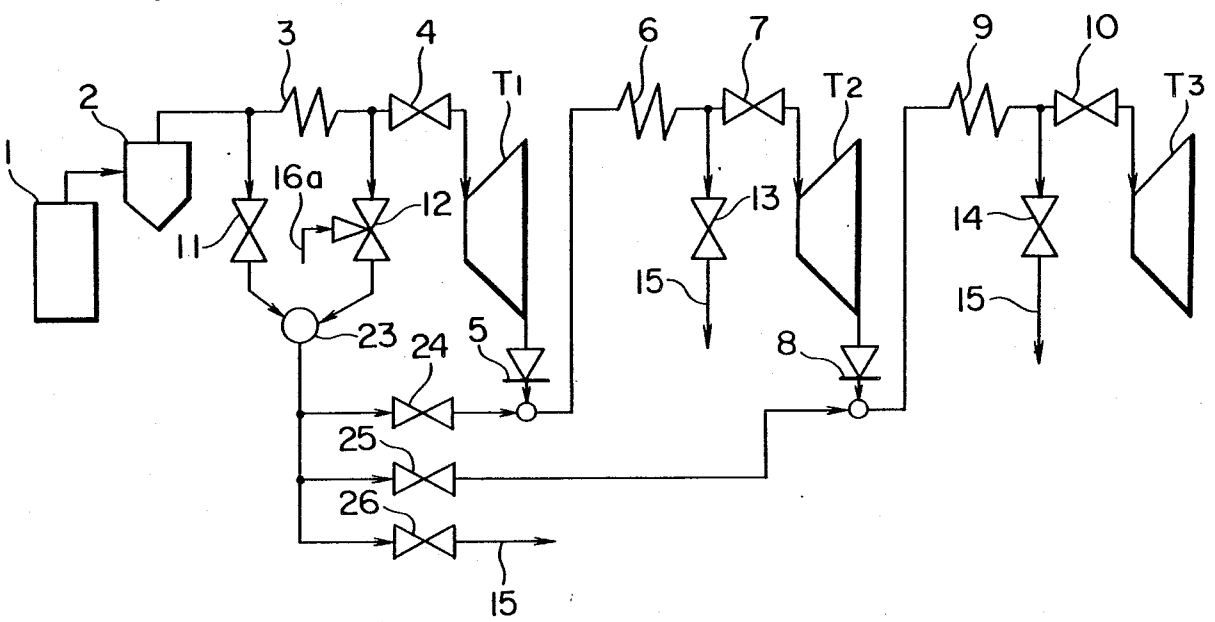
FIG. 1 is a steam flow diagram of a first embodiment of the system of the invention for starting a boiler having a two-stage reheater system.
Figure 5:
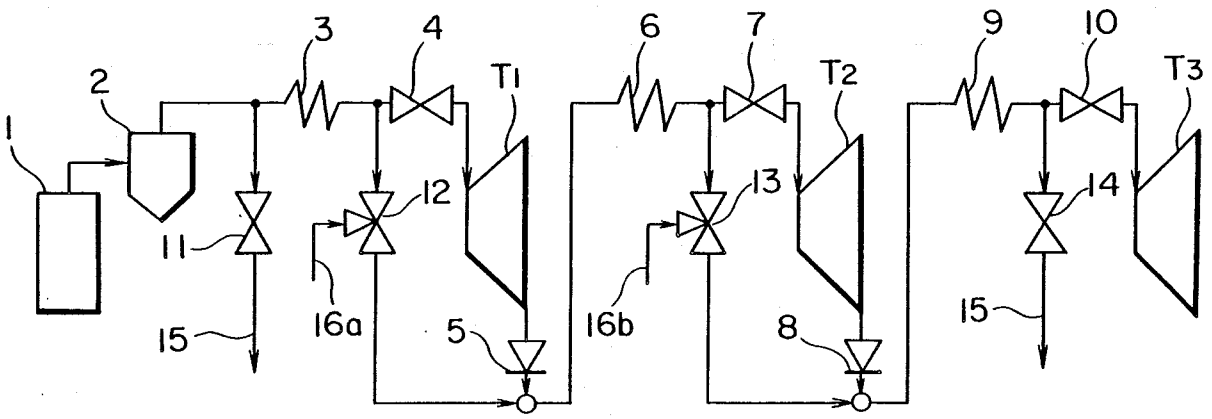
FIG. 5 PRIOR ART
FIG. 5 is a steam flow diagram of a known boiler starting system for starting a boiler having a two-staged reheater.
Figure 7:
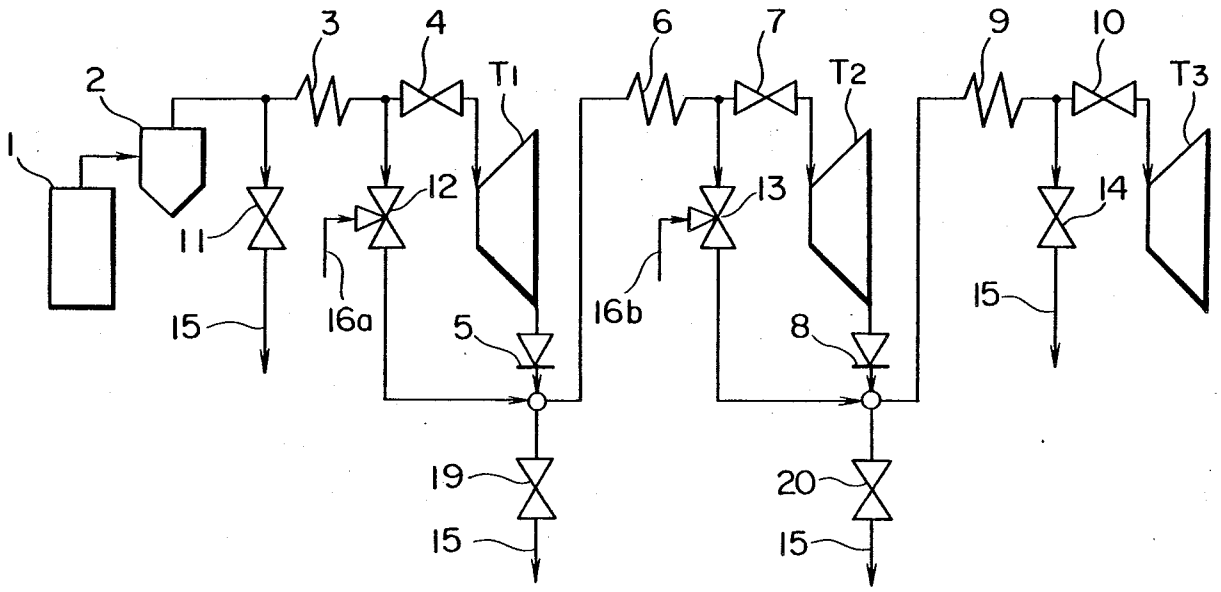
FIG. 7 PRIOR ART
FIG. 7 is a steam flow diagram of another known boiler starting system for starting a boiler having a two-stage reheating system.

FIG. 1 is a steam flow diagram of a first embodiment of the boiler starting system of the invention for starting a boiler having a two-staged reheating system. In this Figure, the same reference numerals are used to denote the same elements as those appearing in FIG. 5, and the descriptions of such elements are omitted to avoid duplication of explanation. As will be seen from FIG. 1, the boiler starting system has a cooling steam mixing portion 23 in which are mixed the steam coming from the superheater by-pass valve 11 and the steam coming from the super-high-pressure turbine by-pass valve 12. The outlet of the cooling steam mixing portion 23 is branched into three lines, a first line having a first-stage reheater cooling steam supply valve 24 for supplying the cooling steam to the first-stage reheater 6, a second line having a second-stage reheater cooling steam supply valve 25 for supplying the cooling steam to the second-stage reheater 9, and a third line having an excess cooling steam discharge valve 26 for discharging the cooling steam to the condenser damp line.

The operation of this embodiment will be explained with reference to FIGS. 2A and 2B which are prepared in the same manner as FIGS. 6A, 6B and 8A, 8B and 10A, 10B.

As stated before, when the boiler is started, the super-high-pressure turbine stop valve 4, the high-pressure turbine stop valve 7 and the medium-pressure turbine stop valve 10 are all closed. The steam from the steam separator 2 is divided into two branches, one of which extends to the superheater 3 and the other extends to the superheater by-pass valve 11. The branched steam from the superheater 3 is introduced through the super-high-pressure turbine by-pass valve 12 into the cooling steam mixing portion 23 where it is mixed with the steam from the superheater by-pass valve 11. Cooling water from the water spray line 16*a* is sprayed into the super-high-pressure turbine by-pass valve 12. Thus, the flow rate of the steam in the cooling steam mixing portion 23 corresponds to the sum of the amount of steam generated in the boiler and the amount of water sprayed in the valve 12 from the water spray line 16*a*, as will be seen from FIG. 2B. A part of the cooling steam mixed in the cooling steam mixing portion 23 is introduced into the first-stage reheater 6 through the first-stage reheater cooling steam supply valve 24, and another part of the cooling steam is introduced into the second-stage reheater 9 through the second-stage reheater cooling steam supply valve 25. Excess cooling steam, if any, is discharged to the condenser damp line 15 through the excess cooling steam discharge valve 26.

The superheater by-pass valve 11 is adapted to control the steam flow rate to be supplied to the superheater 3 such that the steam temperature at the outlet of the superheater 3 rises to a predetermined level in a predetermined period. Similarly, the first-stage reheater cooling steam supply valve 24 controls the flow rate of steam to be supplied to the first-stage reheater 6 such that the steam temperature at the outlet of the first-stage reheater 6 is raised to a predetermined level in a predetermined period, while the second-stage reheater cooling steam supply valve 25 controls the flow rate of the steam to be supplied to the second-stage reheater 9 in such a manner that the steam temperature at the outlet of the second-stage reheater is raised to a predetermined level in a predetermined period. If there is any excess cooling steam as a result of the control of the flow rates by respective valves, such excess steam is discharged through the excess cooling steam discharge valve 26. Meanwhile, the super-high-pressure turbine by-pass valve 12, the high-pressure turbine by-pass valve 13 and the medium-pressure turbine by-pass valve 14 are operated such that predetermined steam pressure are maintained in the superheater 3, the first-stage reheater 6 and the second-stage reheater 9.

According to this arrangement, the flow rates of the steam not only in the superheater, but in the first-stage reheater and the second-stage reheater can be optimumly controlled by independent operations of the superheater by-pass valve, the first-stage reheater cooling steam supply valve and the second-stage reheater cooling steam supply valve, until the excess cooling steam discharge valve is fully closed. In consequence, the control of the temperature rise of the steam in the super-heater and the two reheaters can be conducted easily, so that it becomes possible to substantially equalize the periods required for raising the steam temperatures to the predetermined levels in the superheater and the reheaters as shown in FIG. 2A. In addition, the flow rates of steam in the respective reheaters can be varied from zero to a considerably large value, so that the steam temperatures at the outlets of respective reheaters can be controlled over wide ranges, in spite of a comparatively small number of valves. Furthermore, since the cooling of reheaters is effected by the use of the steam which has by-passed the superheater and, hence, has a comparatively low temperature, the required amount of water to be sprayed is decreased correspondingly, thus allowing the capacities of the system elements to be reduced. Furthermore, since the cooling of the reheaters is conducted by the steam of low temperature extracted from the inlet side of the superheater, the number of parts which are subjected to superheated steam, as well as the flow rate of the superheated steam, is reduced to eliminate the aforesaid problems attributable to the spray of the cooling water into the superheated steam.

To sum up, the described first embodiment of the invention allows the steam temperatures at the outlets of the superheater and reheaters to be independently controllable.

Figure 3:
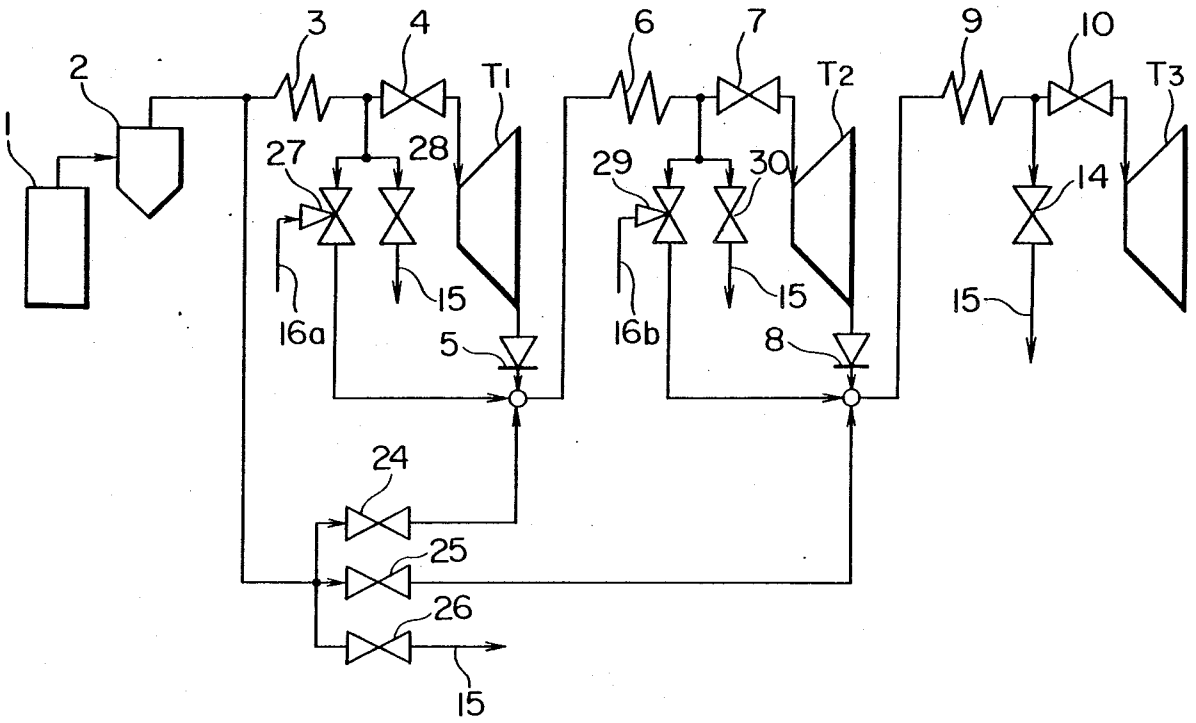
FIGS. 3 and 4 are steam flow diagrams of a second and a third embodiment of the boiler starting system of the invention, respectively.

FIG. 3 shows a second embodiment of the boiler starting system of the invention. In this Figure, the same reference numerals are used to denote the same elements as those appearing in FIG. 1, and the descriptions of such elements are omitted duplication of explanation. This embodiment has an auxiliary first-stage reheater cooling steam supply valve 27 (referred to as "first auxiliary valve 27", hereinunder) which is adapted to receive the steam from the outlet of the superheater 3 and to deliver the same to the first-stage reheater 6. The first auxiliary valve 27 is adapted to be supplied with the cooling water from the water spray line 16*a*. This embodiment also has a super-high-pressure turbine by-pass valve 28 connected in parallel with the first auxiliary valve 27 to the outlet of the superheater 3 so as to discharge the steam therefrom into the condenser damp line 15. In addition, an auxiliary second-stage reheater cooling steam supply valve 29 (referred to as "second auxiliary valve 29", hereinunder) which is adapted to receive the steam from the outlet of the first-stage reheater 6 and to supply the same to the second-stage reheater 9. The second auxiliary valve 29 is adapted to be supplied with the cooling water from the water spray line 16*b*. A reference numeral 30 designates a valve which is disposed in parallel with the second auxiliary valve 29 so as to receive the steam from the outlet of the first-stage reheater 6 and to discharge the same to the condenser damp line 15.

The operation of this embodiment is explained as follows. During starting of the boiler, the flow of the steam from the steam separator 2 is branched into the superheater 3, the first-stage reheater cooling steam supply valve 24, the second-stage reheater steam supply valve 25, and the excess cooling steam discharge valve 26. The steam coming out of the superheater 3 is further divided into a fraction which is introduced into the first auxiliary valve 27 and a fraction which is introduced to the super-high-pressure turbine by-pass valve 28. The steam introduced into the first auxiliary valve 27 is cooled by the water sprayed from the water spray line 16*a*, and the cooled steam is mixed with the steam from the first-stage reheater cooling steam supply valve 24. The mixture steam is then introduced into the first-stage reheater 6. The steam from the first-stage reheater 6 is divided into a fraction which is introduced into the second auxiliary valve 29 and a fraction which is introduced into the high-pressure turbine by-pass valve 30. The steam introduced into the second auxiliary valve 29 is cooled by water sprayed from the water spray line 16*b*, and the cooled steam is mixed with the steam from the second-stage reheater cooling steam supply valve 25. The mixture steam is then introduced into the second-stage reheater 9.

This embodiment also permits the capacities of system elements to be reduced, and eliminates problems which otherwise would be caused by the spray of cooling water into superheated steam. In addition, the control of the steam temperature rise can be readily conducted in this embodiment, although the control operation itself may be complicated due to an increase in the number of valves employed, as compared with the preceding embodiment. It is to be understood also that, in the case where the flow rate of the steam from the steam separator 2 is smaller than the total steam flow rate required for cooling both reheaters, it is possible to make a common use of the cooling steam for both reheaters, by virtue of the second auxiliary valve 29, so that flow rates necessary for cooling both reheaters are maintained in both reheaters.

Figure 4:
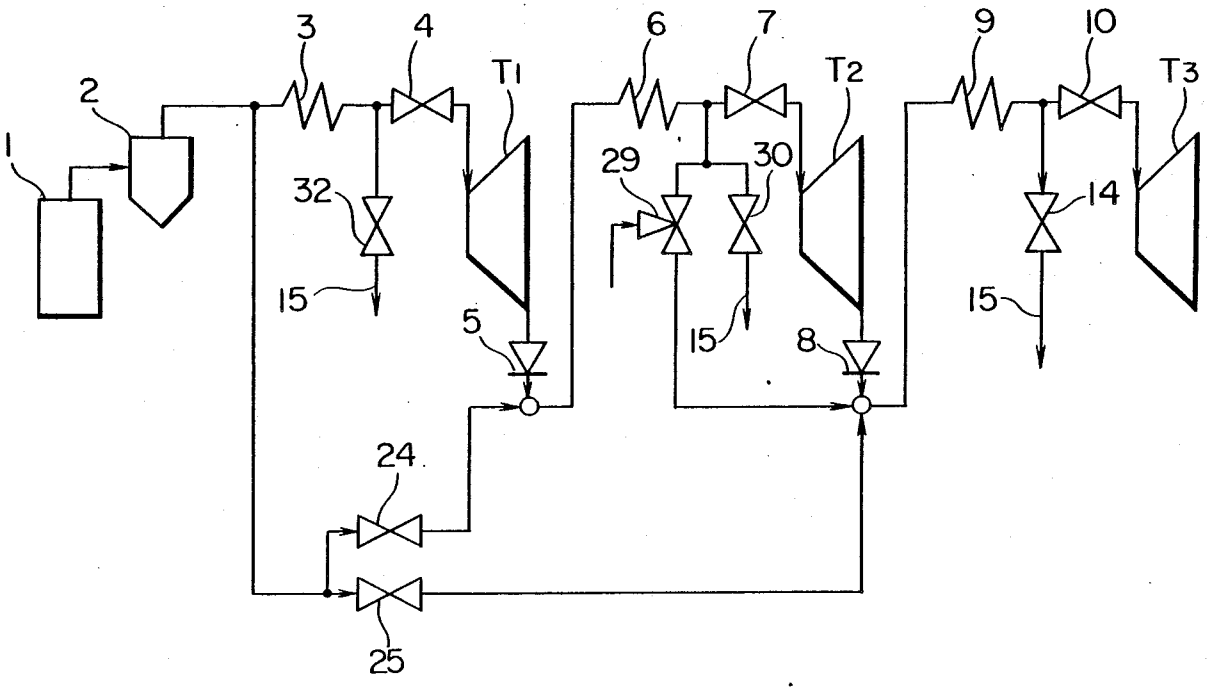

FIG. 4 shows a third embodiment of the boiler starting system of the invention. In this Figure, the same reference numerals are used to denote the same elements as those appearing in FIG. 3, and the descriptions of such elements are omitted to avoid duplication of explanation. The third embodiment has a super-high-pressure turbine by-pass valve 32 instead of the first auxiliary valve 27 and the super-high-pressure by-pass valve 28 which are used in the second embodiment shown in FIG. 3. The third embodiment also lacks the excess cooling steam discharge valve 26. The super-high-pressure turbine by-pass valve 32 is directly connected to the condenser damp line.

The flow of steam from the steam separator 2 is branched into the superheater 3, the first-stage reheater cooling steam supply valve 24 and the second-stage reheater cooling steam supply valve 25. The flow rate of the steam flowing through the superheater 3 is controlled by a super-high-pressure turbine by-pass valve 32 such that a predetermined steam pressure is maintained at the outlet of the superheater 3. The steam which has been introduced into the first-stage reheater cooling steam supply valve 24 is sent to the first-stage reheater 6, while the steam introduced into the second-stage reheater cooling steam supply valve 25 is sent to the second-stage reheater 9. The first- and second-stage reheater cooling steam supply valves 24 and 25 are controlled such that a steam flow rate sufficiently large for cooling the first-stage reheater 6 is maintained. This in turn tends to cause a shortage in the cooling steam to the second-stage reheater 9. This shortage of the cooling steam, however, is compensated for by the increase in the steam flow rate caused by the spray of cooling water into the steam flowing through the second auxiliary valve 29, so that the cooling of the second-stage reheater 9 can be executed without fail.

It will be seen that the third embodiment offers advantages equivalent to those derived from the second embodiment, while using a smaller number of valves than the first and the second embodiments. In addition, it is not necessary to spray cooling water into the super-high-pressure turbine by-pass valve, which in turn eliminates the necessity for the countermeasure which otherwise has to be taken in consideration, namely the thermal impact caused by the water spray on the thick super-high-pressure turbine by-pass valve.

In the first to third embodiments described hereinbefore, the steam for cooling the reheaters is extracted form the inlet side of the superheater. This, however, is not exclusive and the cooling steam may be extracted from an intermediate portion of the superheater, e.g., from the portion between the primary and secondary superheater units or from the portion between the secondary and tertiary superheater units.

Figure 11:
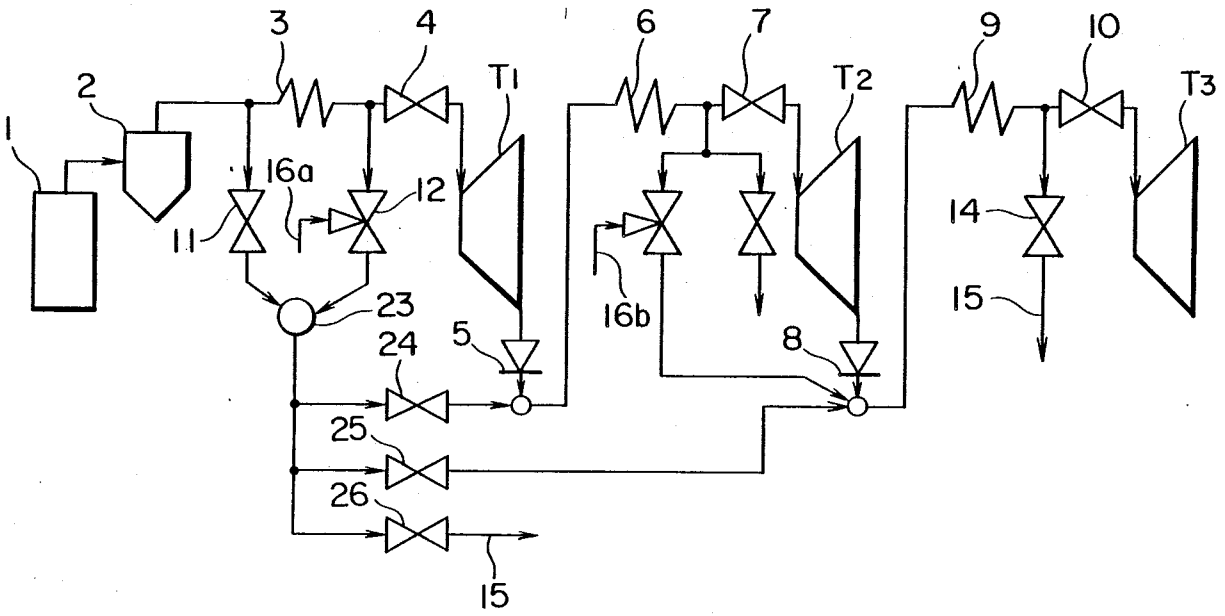
FIGS. 11 to 15 show steam flow diagrams of different embodiments of the boiler starting system in accordance with the invention, respectively.

FIG. 11 shows a fourth embodiment of the boiler starting system of the invention. In this Figure, the same reference numerals are used to denote the same elements appearing in corresponding Figures showing the first to third embodiments. The operation of this fourth embodiment will be self-evident from the foregoing description. This fourth embodiment offers, in addition to the advantages derived from the first embodiment, an advantage in that sufficiently large steam flow rates are ensured for both reheaters even when the rate of generation of the steam is comparatively small.

Figure 12:
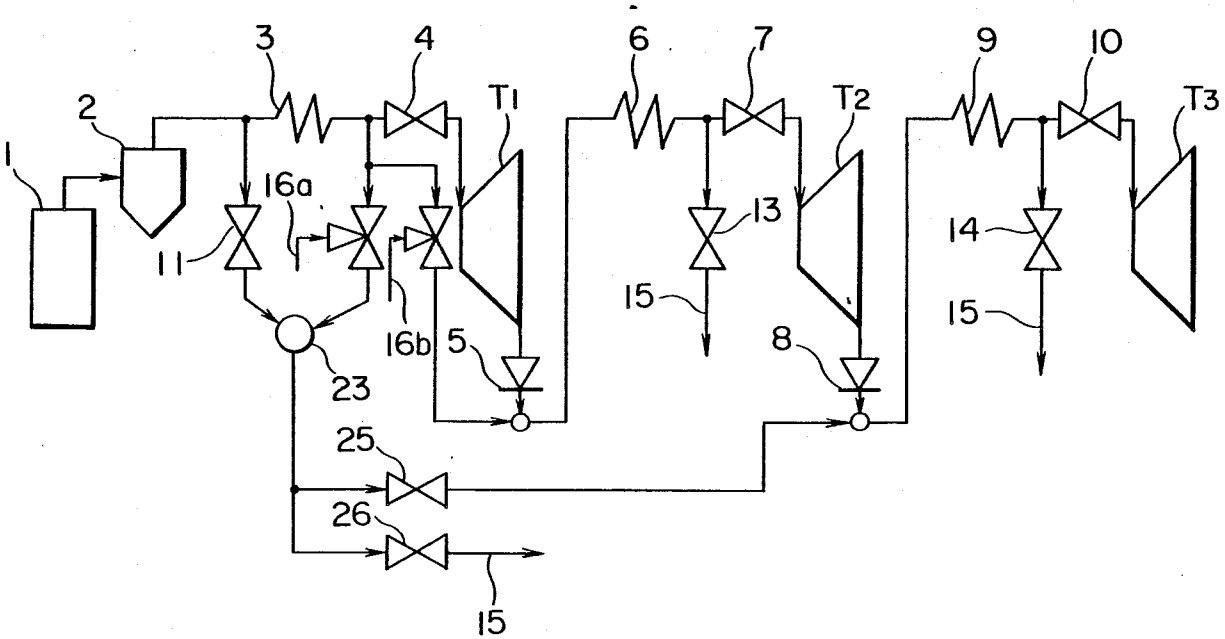

FIG. 12 shows a fifth embodiment of the boiler starting system of the invention. In this Figure, the same reference numerals are used to denote the same elements which appear in corresponding Figures showing the first to fourth embodiments. The description of operation is omitted for the same reason as that for the fourth embodiment. This fifth embodiment is advantageous in that the steam temperatures at the outlets of the superheater and the reheaters can be controlled independently. The embodiment is preferably applicable to the case where the reheaters require different steam temperatures.

Figure 13:
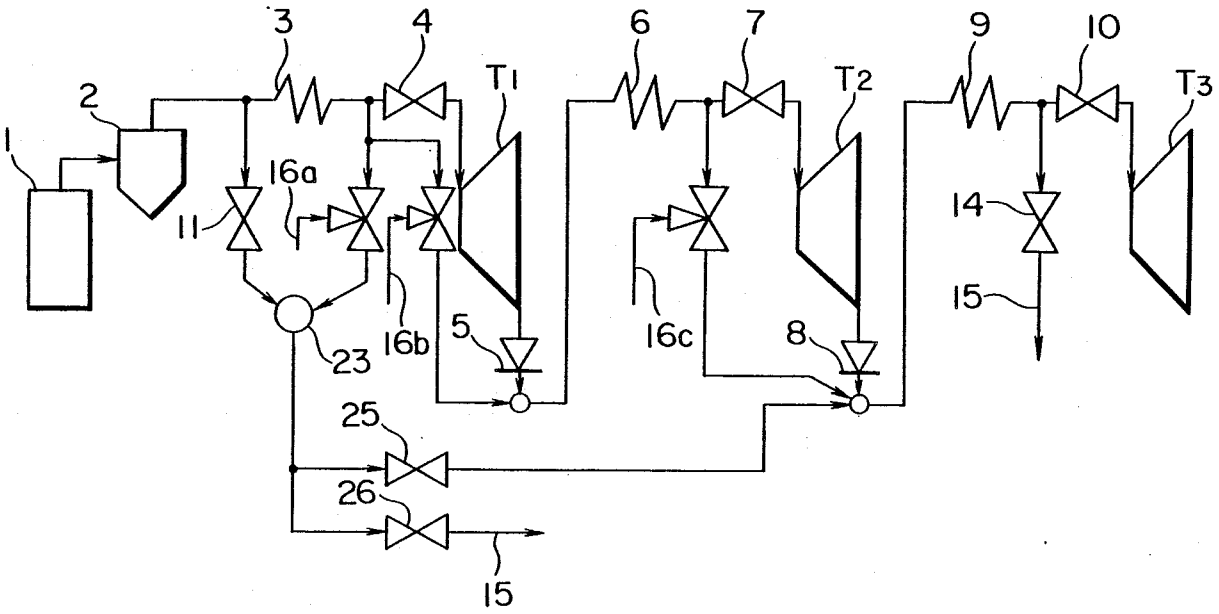

FIG. 13 shows a sixth embodiment of the boiler starting system of the invention. In this Figure, the same reference numerals are used to denote the same elements as those appearing in corresponding Figures showing the first to fifth embodiments. The description of operation of this embodiment is not described for the same reason as that for the fourth and fifth embodiments. This sixth embodiment offers, besides the advantages brought about by the fifth embodiment, an advantage in that the reheaters are supplied with the cooling steam at sufficiently large rates even when the rate of generation of the steam is comparatively small.

Figure 14:
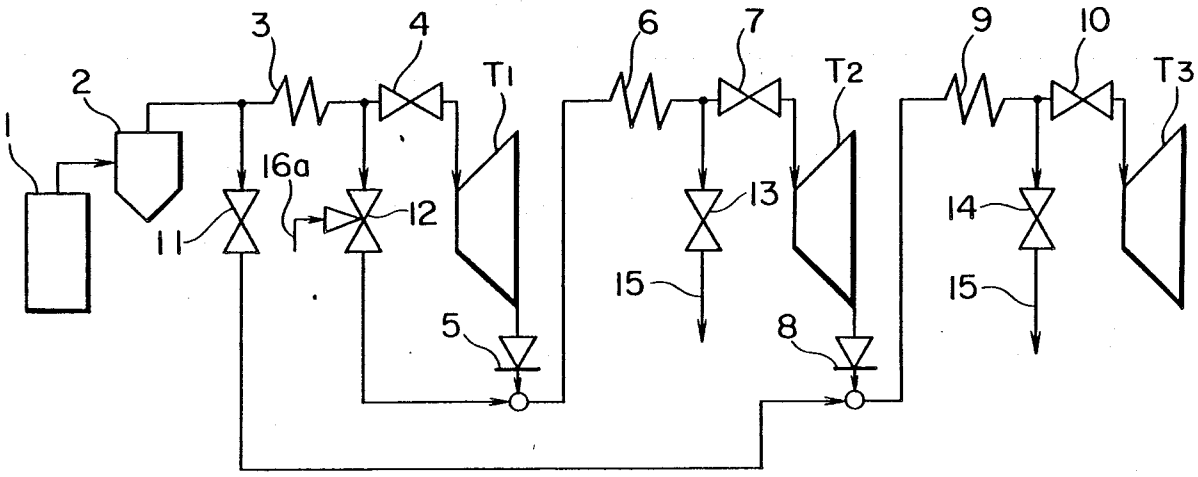
Figure 15:
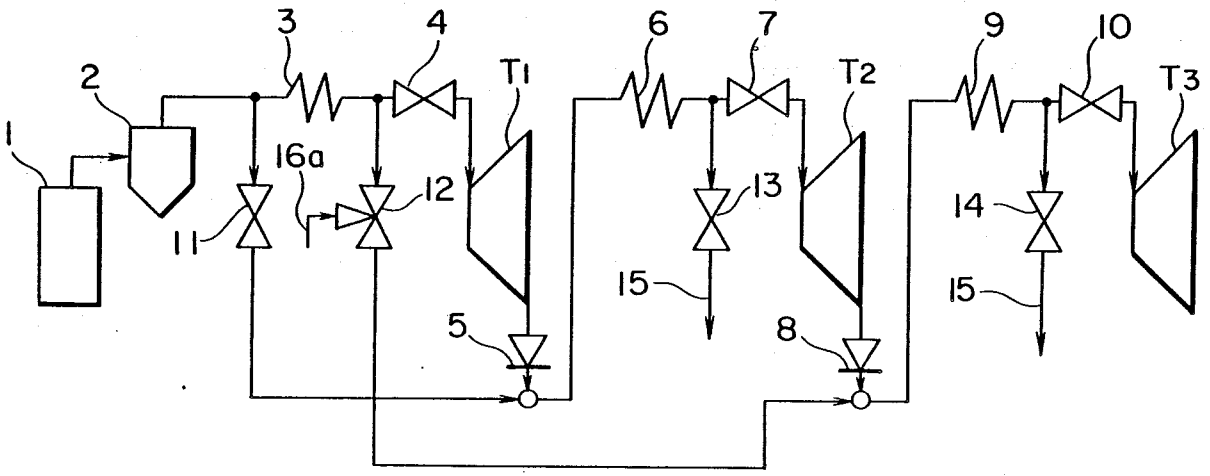

FIGS. 14 and 15 show seventh and eighth embodiments of the invention. In these Figures, the same reference numerals are used to denote the same elements appearing in corresponding Figures showing first to sixth embodiments. The description of operation is omitted also in this case for the same reason as that stated before. The seventh and eighth embodiments feature the simple and reliable system arrangements and are suitable for use in the case where both reheaters require different cooling steam temperatures.

As has been described, according to the invention, the cooling steam for cooling the reheaters is constituted mainly by low-temperature steam which is extracted from the inlet side or an intermediate portion of the superheater. This arrangement affords an easiness in the control of the temperature rise in the superheater and reheaters, while allowing a reduction in the capacities of the elements. In addition, the necessity for the countermeasures against problems which are caused by the spray of the cooling water is eliminated, as is the risk of generation of excess steam of low temperature.

What is claimed is

1. A boiler starting, system for a boiler having a superheater and reheaters, said superheater including an inlet portion for receiving steam, a superheating portion for superheating the received steam, and an outlet portion through which the superheated steam is discharged, said boiler starting system comprising: a steam extracting means for extracting steam from other portions of said superheater than said outlet portion, and a steam supplying means for supplying the steam extracted by said steam extracting means to at least one of said reheaters, wherein said steam supplying means includes a mixing portion for mixing the steam extracted by said steam extracting means with the steam from said outlet portion of said superheater, and a valve means for distributing the mixture steam to said respective reheaters.

2. A boiler starting, system for a boiler having a superheater and reheaters, said superheater including an inlet portion for receiving steam, a superheating portion for superheating the received steam, and an outlet portion through which the superheated steam is discharged, said boiler starting system comprising: a steam extracting means for extracting steam from other portions of said superheater than said outlet portion, and a steam supplying means for supplying the steam extracted by said steam extracting means to at least one of said reheaters, wherein said steam supplying means includes a valve means having a plurality of valves for distributing the steam extracted by said steam extracting means to said respective reheaters, and a mixing portion in which the steam from said outlet portion of said superheater is mixed with the steam from one of the valves of said valve means corresponding to the reheater which is the most upstream.

3. A boiler starting, system for a boiler having a superheater and reheaters, said superheater including an inlet portion for receiving steam, a superheating portion for superheating the received steam, and an outlet portion through which the superheated steam is discharged, said boiler starting system comprising: a steam extracting means for extracting steam from other portions of said superheater than said outlet portion, and a steam supplying means for supplying the steam extracted by said steam extracting means to at least one of said reheaters, wherein said steam supplying means includes a valve means having a plurality of valves for distributing the steam extracted by said steam extracting means to said respective reheaters, and a mixing portion in which the steam from one of the valves of said valve means corresponding to a downstream side reheater is mixed with the steam from one of the valves of said valve means corresponding to an upstream side reheater.

4. A boiler starting system according to claim 2, wherein said steam supplying means further includes a mixing portion in which the steam from one of the valves of said valve means corresponding to a downstream side reheater is mixed with the steam from another valve of said valve means corresponding to an upstream side reheater.

5. A boiler starting system according to claim 3, wherein said steam supplying means further includes a mixing portion in which the steam extracted by said steam extracting means is mixed with the steam from said outlet portion of said superheater, and a valve means for distributing the steam from said mixing portion to said respective reheaters.

6. A boiler starting system for a boiler having a superheater and reheaters, said superheater including an inlet portion for receiving steam, a superheating portion for superheating the received steam, and an outlet portion through which the superheated steam is discharged, said boiler starting system comprising: a steam extracting means for extracting steam from other portions of said superheater than said outlet portion, and a steam supplying means for supplying the steam extracted by said steam extracting means to at least one of said reheaters, and wherein said steam supplying means supplies steam from said outlet portion of said superheater to the reheater which is the most upstream.

7. A boiler starting system according to claim 6, wherein said steam supplying means includes a valve means having a plurality of valves for distributing the steam extracted by said steam extracting means to said reheaters, and a mixing portion in which the steam from one of the valves of said valve means corresponding to a downstream side reheater is mixed with the steam from another valve of said valve means corresponding to an upstream side reheater.

* * * * *